US007434914B2

(12) United States Patent
Ito

(10) Patent No.: US 7,434,914 B2
(45) Date of Patent: Oct. 14, 2008

(54) INKJET RECORDING HEAD

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 499 days.

(21) Appl. No.: 11/191,179

(22) Filed: Jul. 26, 2005

(65) Prior Publication Data

US 2006/0017779 A1 Jan. 26, 2006

(30) Foreign Application Priority Data

Jul. 26, 2004 (JP) ..... 2004-217474

(51) Int. Cl.
*B41J 2/14* (2006.01)
*B41J 2/16* (2006.01)

(52) U.S. Cl. ..... 347/50; 347/68

(58) Field of Classification Search ..... 347/50, 347/57–59, 68, 70–71
See application file for complete search history.

(56) References Cited

U.S. PATENT DOCUMENTS 5,889,539 A * 3/1999 Kamoi et al. ..... 347/50
6,672,715 B2 1/2004 Isono et al. ..... 347/71

FOREIGN PATENT DOCUMENTS

| | | |
|---|---|---|
| JP | 55-67849 | 5/1980 |
| JP | 1-8371 | 3/1989 |
| JP | 2003-80709 | 3/2003 |

* cited by examiner

*Primary Examiner*—Juanita D Stephens
(74) *Attorney, Agent, or Firm*—Reed Smith LLP

(57) ABSTRACT

An inkjet recording head including a channel unit which includes an electrically conductive member and has a plurality of pressure chambers which communicate with a plurality of nozzles, respectively; a plurality of individual electrodes which are associated with the plurality of pressure chambers, respectively; and a flexible flat cable including a plurality of individual wires which are electrically connected to the plurality of individual electrodes, respectively, a grounding wire which is held at a ground potential, and an electrically insulating flexible layer which supports the individual wires and the grounding wire. The grounding wire includes an extension portion which is electrically connected to the electrically conductive member of the channel unit, and the electrically insulating flexible layer includes a projection portion which supports a portion, or an entirety, of the extension portion of the grounding wire.

28 Claims, 13 Drawing Sheets

INKJET RECORDING HEAD

The present application is based on Japanese Patent Application No. 2004-217474 filed on Jul. 26, 2004, the contents of which are incorporated herein by reference.

BACKGROUND OF THE INVENTION

1. Field of the Invention

The present invention relates to an inkjet recording head that ejects ink toward a recording medium and thereby performs recording on the medium.

2. Discussion of Related Art

There is known an inkjet recording head that is employed by, e.g., an inkjet printer, and includes a plurality of pressure chambers to each of which ink is supplied from an ink storage tank; and a plurality of nozzles communicating with the pressure chambers, respectively. When a pressure pulse or change is applied to an arbitrarily selected one of the pressure chambers, the nozzle communicating with the selected pressure chamber ejects a droplet of ink toward a recording sheet.

For example, Japanese Patent Application Publication P2003-80709A or its corresponding U.S. Pat. No. 6,672,716B2 discloses an inkjet recording head having a piezoelectric actuator (i.e., an actuator unit) that includes a continuous piezoelectric sheet; a common electrode that is opposed to each of a plurality of pressure chambers; and a plurality of individual electrodes that are opposed to the pressure chambers, respectively, and cooperate with the common electrode to sandwich a plurality of active portions of the piezoelectric sheet, respectively. This inkjet recording head additionally includes a cavity unit (i.e., a channel unit) having the pressure chambers. In the inkjet recording head, an electrically conductive adhesive is applied to a side surface of the piezoelectric actuator, such that the conductive adhesive is connected to an upper surface of the cavity unit and extends in a direction in which the piezoelectric sheet and the common and individual electrodes are stacked on each other in the actuator. Thus, the conductive adhesive electrically connects the cavity unit to the common electrode of the piezoelectric actuator, so that both the cavity unit and the common electrode are grounded.

SUMMARY OF TEE INVENTION

In the inkjet recording head disclosed by the above-indicated patent document, however, the cavity unit and the common electrode are connected to each other by a large amount of the conductive adhesive and accordingly the conductive adhesive may spread over the piezoelectric actuator. If the conductive adhesive spreads over an upper surface of the piezoelectric actuator, then a plurality of surface electrodes that are provided on the upper surface of the actuator and are connected to the individual electrodes, respectively, may be electrically connected to each other through the adhesive, i.e., may be shortcircuited. In addition, after the conductive adhesive is applied to the side surface of the piezoelectric actuator, it is needed to carry out an additional stop to control a shape of the large amount of conductive adhesive. This leads to increasing a production cost of the inkjet recording head.

It is therefore an object of the present invention to provide an inkjet recording head free of at least one of the above-indicated problems. It is a particular object of the present invention to provide an inkjet recording head that can prevent shortcircuiting of individual electrodes and/or can be produced at low cost.

According to a first aspect of the present invention, there is provided an inkjet recording head including a channel unit including at least one electrically conductive member, and having a plurality of pressure chambers which communicate with a plurality of nozzles, respectively; a plurality of individual electrodes which are associated with the plurality of pressure chambers, respectively; and a flexible flat cable including a plurality of individual wires which are electrically connected to the plurality of individual electrodes, respectively, a grounding wire which is held at a ground potential, and an electrically insulating flexible layer which supports the individual wires and the grounding wire. The grounding wire includes an extension portion which is electrically connected to the at least one electrically conductive member of the channel unit, and the electrically insulating flexible layer includes a projection portion which supports at least a portion of the extension portion of the grounding wire.

According to a second aspect of the present invention, there is provided an inkjet recording head including a channel unit including at least one first electrically conductive member, and having a plurality of pressure chambers which communicate with a plurality of nozzles, respectively; a frame which includes at least one second electrically conductive member and which is fixed to the channel unit such that the at least one second electrically conductive member is electrically connected to the at least one first electrically conductive member; a plurality of individual electrodes which are associated with the pressure chambers, respectively; and a flexible flat cable including a plurality of individual wires that are electrically connected to the individual electrodes, respectively, a grounding wire which is held at a ground potential, and an electrically insulating flexible layer which supports the individual wires and the grounding wire. The grounding wire includes an extension portion which is electrically connected to the at least one second electrically conductive member of the frame, and the electrically insulating flexible layer includes a projection portion which supports at least a portion of the extension portion of the grounding wire.

In the inkjet recording head in accordance with the first or second aspect of the present invention, the channel unit is electrically connected to the grounding wire of the flexible flat cable, and is grounded via the grounding wire. Therefore, unlike the conventional inkjet recording head disclosed by the previously indicated patent document, it is not needed to use a large amount of electrically conductive adhesive, for the purpose of preventing the shortcircuiting of the individual electrodes. In addition, it is not needed to carry out a step of controlling a shape of the large amount of electrically conductive adhesive. This leads to reducing the production cost of the present inkjet recording head.

According to a third aspect of the present invention, there is provided an inkjet recording head including a channel unit including an electrically conductive portion, and having a plurality of pressure chambers which communicate with a plurality of nozzles, respectively; a plurality of individual actuators each of which applies a pressure change to a corresponding one of the pressure chambers so as to eject a droplet of ink from a corresponding one of the nozzles; and a flexible flat cable including a plurality of individual wires which are electrically connected to the plurality of individual actuators, respectively, a grounding wire which is commonly connected to the individual actuators and is held at a ground potential and an electrically insulating flexible layer which supports the individual wires and the grounding wire. The grounding wire includes a connection portion which is electrically connected to the electrically conductive portion of the channel unit, and the electrically insulating flexible layer includes a support portion which supports at least a portion of the connection portion of the grounding wire.

The inkjet recording head in accordance with the third aspect of the present invention can enjoy the same advantages as the above-described advantages of the inkjet recording head in accordance with the first or second aspect of the present invention. The inkjet recording head in accordance with the third aspect of the present invention can employ one or more features of the features recited in claims 1 through 27 of the present application.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF TEE PREFERRED EMBODIMENT

Hereinafter, there will be described preferred embodiments of the present invention by reference to the drawings.

Figure 1:
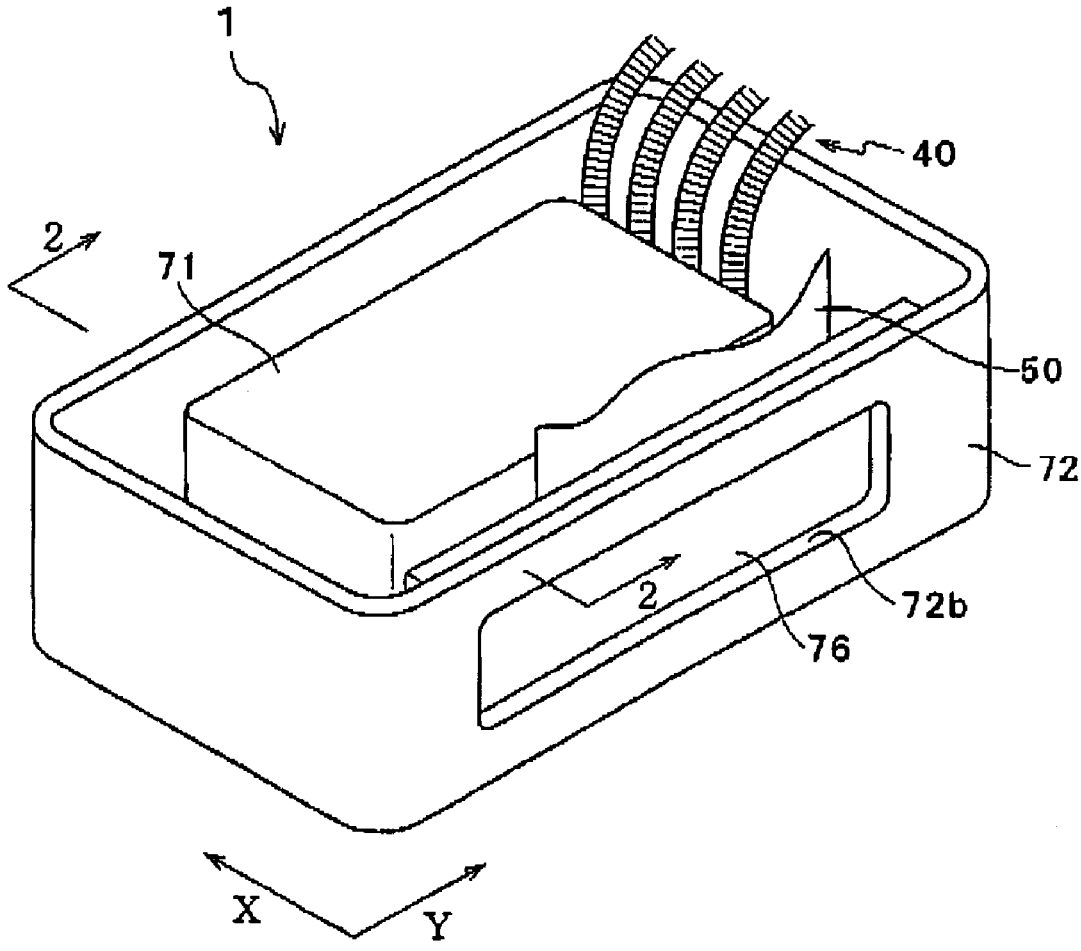
FIG. 1 is a perspective view of an inkjet recording head as a first embodiment of the present invention.
Figure 2:
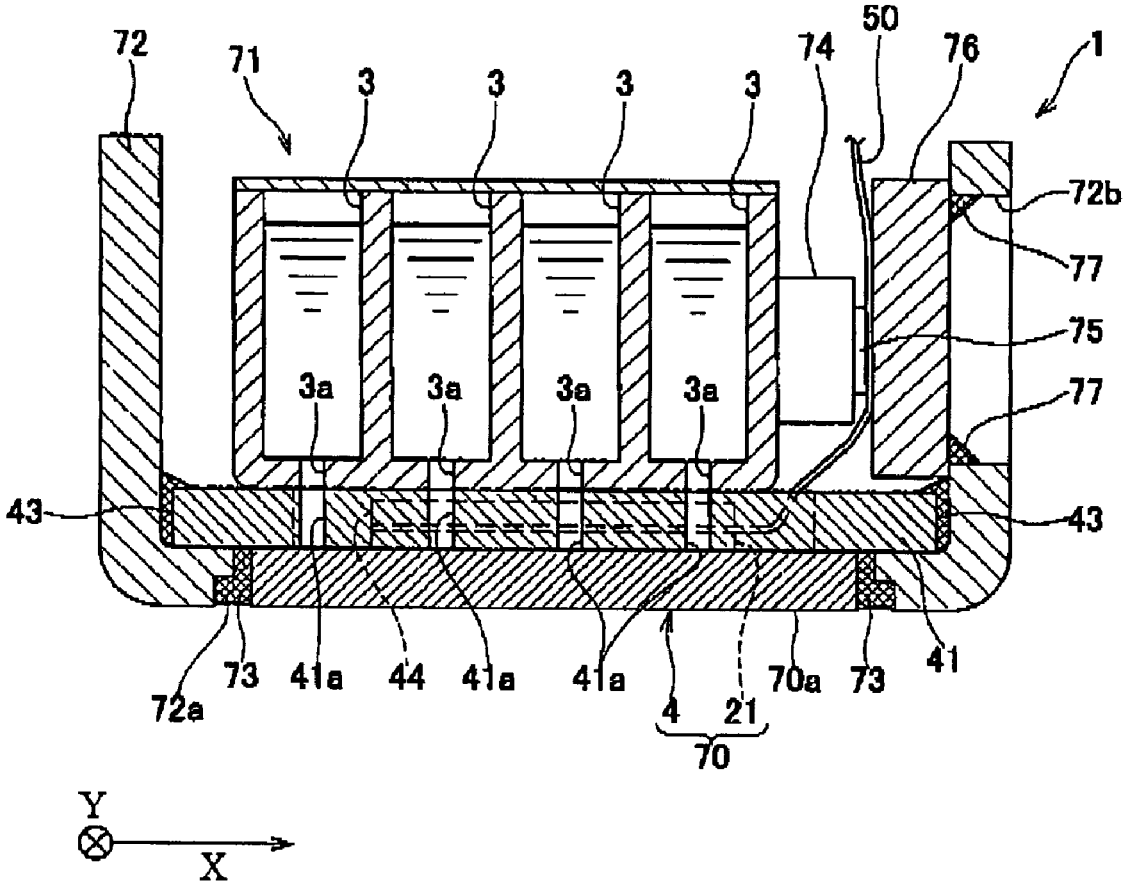
FIG. 2 is a cross-section view taken along 2-2 in FIG. 1.
Figure 3:
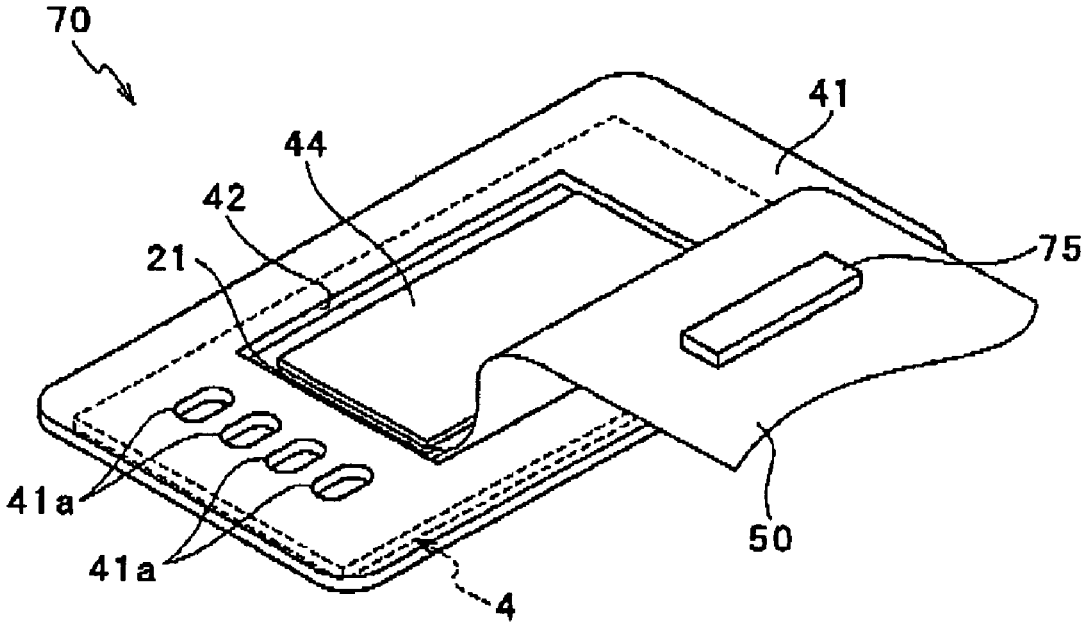
FIG. 3 is a perspective view showing a state in which a frame is adhered to a main body of the inkjet recording head.
Figure 4:
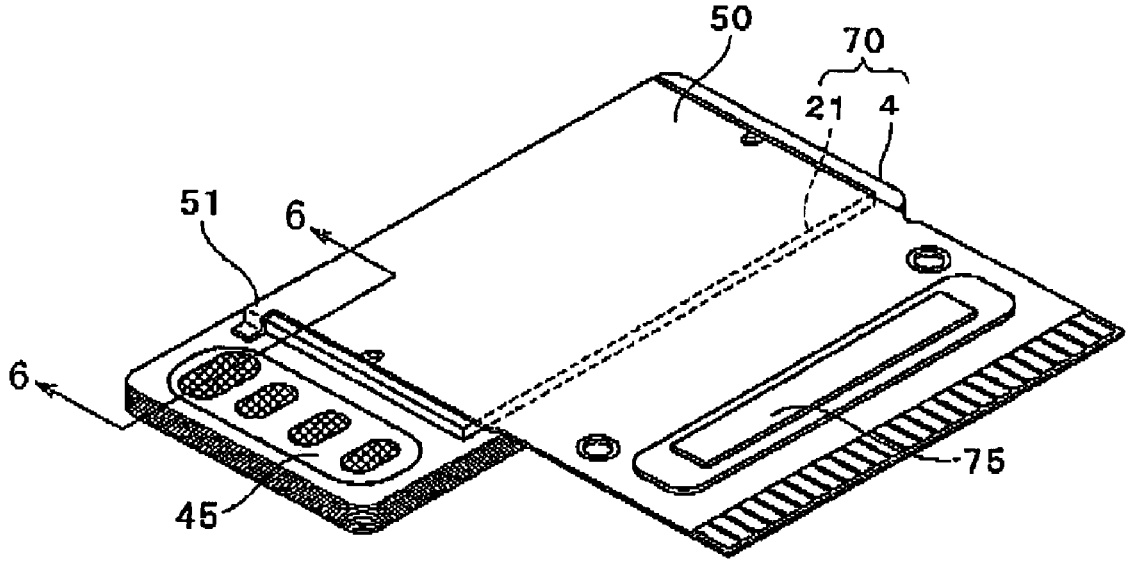
FIG. 4 is a perspective view showing a state in which a FPC (flexible printed circuit) is fixed to the main body of the inkjet recording head.

FIG. 1 shows an inkjet recording head 1 as a fit embodiment of the present invention. FIG. 2 shows a state in which a main body 70 of the inkjet recording head 1 is assembled with a holder 72 as a portion of the inkjet recording head 1. FIG. 3 shows a state in which a frame 41 is adhered to the main body 70. FIG. 4 shows a state in which a FPC flexible printed circuit) 50 as a flexible flat cable is fixed to the main body 70. The inkjet recording head 1 is employed by a serial inkjet printer, not shown, wherein the recording head 1 ejects droplets of four inks, i.e., magenta, yellow, cyan, and black inks toward a recording sheet as a recording medium that is fed in an auxiliary recording direction "Y" perpendicular to a main recording direction "X" in which the recording head 1 is reciprocated, thereby performing recording on the recording sheet. As shown in FIGS. 1 and 2, the inkjet recording head 1 includes an ink delivery tank 71 having four ink delivery chambers 3 that temporarily store the four inks, respectively; the main body 70 that is provided below the ink delivery tank 71; and the FPC 50 that is connected to an upper portion of the main body 70.

In the ink delivery tank 71, the four ink delivery chambers 3 are arranged in an array in the main recording direction X. The four ink delivery chambers 3 temporarily store the magenta, yellow, cyan, and black inks, respectively, in the order from left toward right in FIG. 2. The four ink delivery chambers 3 are connected via respective tubes 40 (see FIG. 1) to four ink cartridges, not shown, respectively, and are supplied with the respective inks from those ink cartridges. As shown in FIGS. 2 and 3, the ink delivery tank 71 is assembled with the frame 41 having a rectangular, flat shape. The frame 41 is fixedly adhered, with an ultraviolet curing agent 43, to the holder 72 having a generally rectangular parallelepiped shape. As shown in FIG. 3, the frame 41 has an opening 42 having a rectangular shape in its plan view. The frame 41 is fixedly adhered to the main body 70, such that an actuator unit 21 (described later) of the main body 70 is located in the opening 42. The ink delivery tank 71 has, in a lower end portion thereof, four ink outlets 3*a* that communicate with the four ink delivery chambers 3, respectively. The frame 41 has, as shown in FIG. 3, four through-holes 41*a* which communicate with the four ink outlets 3*a* of the ink delivery tank 71, respectively, and each of which has an elliptic shape in its plan view.

The main body 70 of the inkjet recording head 1 includes a channel unit 4 having four groups of ink channels corresponding to the four inks, respectively; and the actuator unit 21 that is adhered to an upper surface of the channel unit 4 with a thermosetting epoxy adhesive. As shown in FIG. 4, each of the channel unit 4 and the actuator unit 21 is constituted by a plurality of thin sheets which are stacked on each other and each of which has a rectangular, flat shape. The channel unit 4 and the actuator unit 21 are provided below the ink delivery tank 71. The channel unit 4 has, in a portion of the upper surface thereof where the actuator unit 21 is not adhered, four ink inlets 4*a* (see FIG. 5) each of which has an elliptic shape in its plan view. The channel unit 4 includes a filter 45 that has a number of fine through-holes in each of four portions thereof corresponding to the four ink inlets 4*a*, respectively, and is disposed to cover the four ink inlets 4*a*. Thus, the filter 45 can remove dusts, fine particles, etc. contained in the inks supplied from the ink outlets 3*a* of the ink delivery tank 71 to the ink inlets 4*a* of the channel unit 4.

As shown in FIG. 3, the frame 41 is adhered to the channel unit 4. Owing to this arrangement, the four through-holes 41*a* of the frame 41 communicate with the four ink inlets 4*a* of the channel unit 4, and thereby provide four ink flow passages. Thus, the four ink outlets 3*a* of the ink delivery tank 3, the four through-holes 41*a* of the frame 41, and the four ink inlets 4*a* of the channel unit 4 cooperate with each other to provide four ink flow passages that are connected to the channel unit 4.

As shown in FIG. 2, the holder 72 has, in a lower end portion thereof, a stepped opening 72*a* in which the main body 70 of the inkjet recording head 1 is provided. More specifically described, the main body 70 is attached, via the frame 41, to the holder 72 such that an ink-ejection surface 70*a* of the main body 70 is exposed to the outside. A gap left between the holder 72 and the channel unit 4 is filed with a sealing material 73. The ink-ejection surface 70*a* defines a bottom surface of the main body 70, and has a plurality of ink-ejection nozzles 8 (see FIG. 6) each having a small diameter. The FPC 60 that is also a power-supply member is bonded to the upper surface of the actuator unit 21, and is first led in one direction parallel to the main recording direction X and then in an upward direction while being curved. As shown in FIG. 4, the FPC 50 includes a protruding portion 51 that protrudes from one side of a free end portion thereof toward the channel unit 4. In the present embodiment, the protruding portion 51 protrudes over one side surface of the actuator unit 21, and reaches the channel unit 4. As shown in FIGS. 2 and 3, the FPC 50 has, on an upper surface of a portion thereof that is opposed to the actuator unit 21, an aluminum sheet 44 that protects not only the FPC 50 itself and but also the actuator unit 21 and radiates heat generated by the actuator unit 21. More specifically described, the aluminum sheet 44 is adhered to the FPC 60, and radiates the heat generated by one or more individual electrodes 26 (see FIG. 7) of the actuator unit 21 that is or are operating, thereby averaging the distribution of temperature in the actuator unit 21 as a whole.

As shown in FIG. 2, the FPC 50, bonded to the actuator unit 21, is led upward along one side surface of the ink delivery tank 71 with an elastic member 74 such as a sponge being provided between the FPC 50 and the tank 71, and a driver IC 75 is connected to an intermediate portion of the FPC 50. The FPC 50 is electrically bonded, by soldering, to the individual electrodes 26 of the actuator unit 21, so that drive signals outputted from the driver IC can be transmitted to the actuator unit 21 (described in detail, later).

The holder 72 has, in one side wall thereof that is opposed to the driver IC 75, an opening 72*b*, and a heat sink 76 is provided between the driver IC 75 and the opening 72*b*. The heat sink 76 is constituted by an aluminum plate having a substantially rectangular parallelepiped shape. Thus, the driver IC 50 is elastically pressed, together with the FPC 50, by the elastic member 74, against the heat sink 76. The heat sink 76 cooperates with the opening 72*b* to radiate efficiently the heat generated by the driver IC 75. A gap left between the side wall of the holder 72 and the heat sink 76 is filled with a sealing material 77 that is provided in the opening 72*b*. The sealing material 77 prevents dusts or inks from entering the main body 70 of the inkjet recording head 1.

Figure 5:
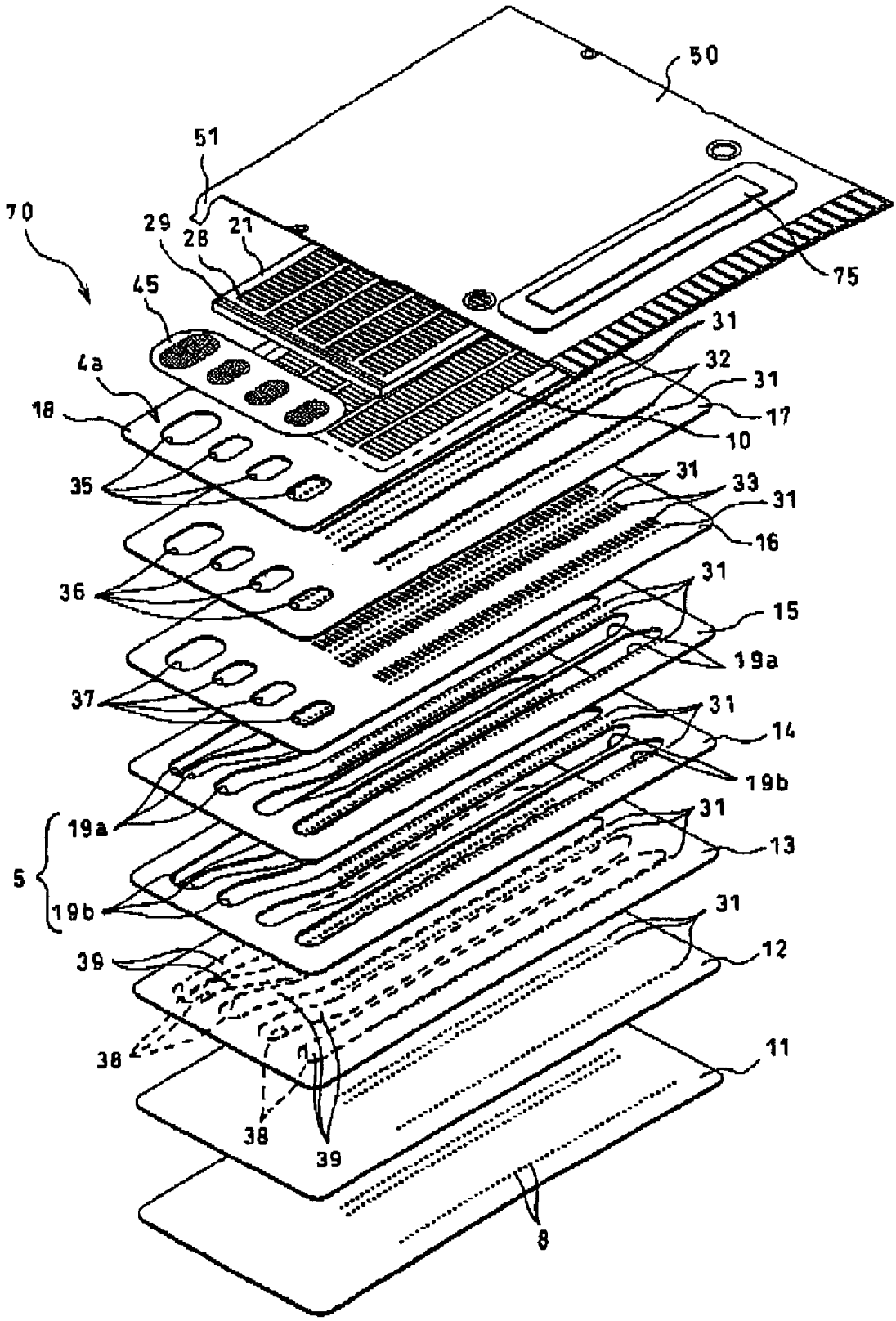
FIG. 5 is an exploded, perspective view of the FPC and the main body of the inkjet recording head.
Figure 6:
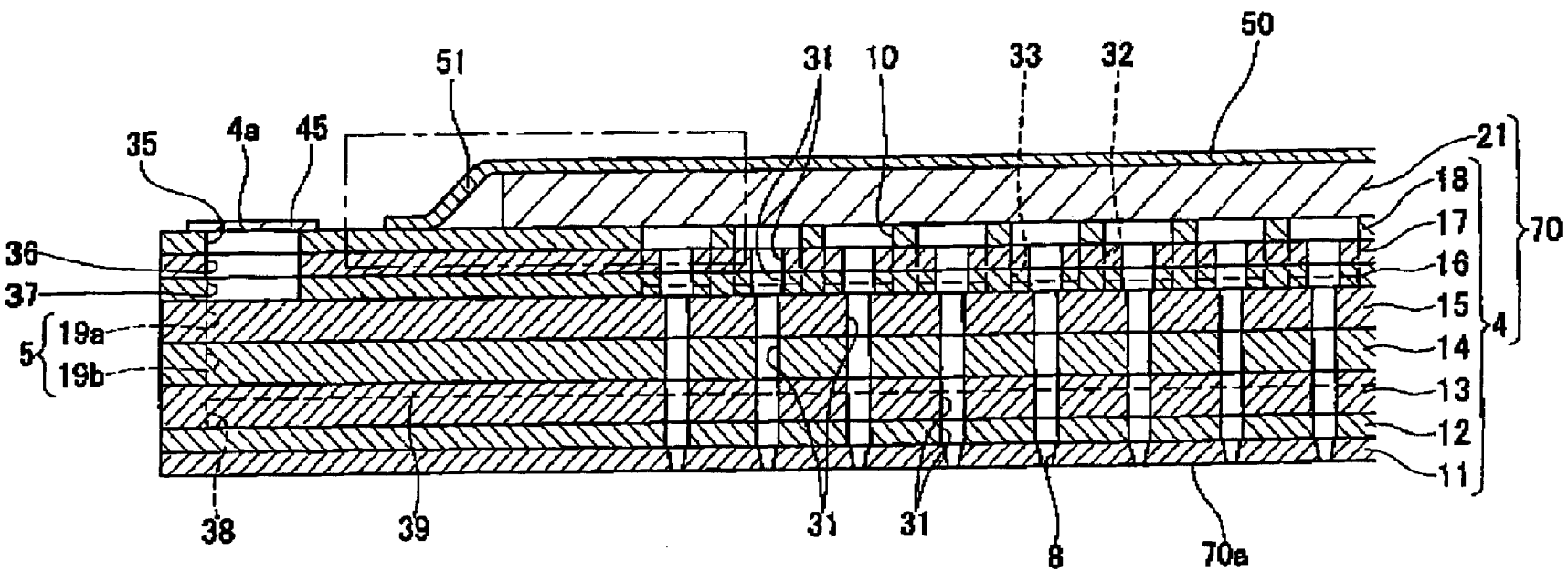
FIG. 6 is a cross-section view taken along 6-6 in FIG. 4.

As shown in FIGS. 5 and 6, the main body 70 of the inkjet recording head 1 includes the channel unit 4 and the actuator unit 21. The channel unit 4 includes eight sheets, i.e., a cavity sheet 18, a supply sheet 17, an aperture sheet 16, two manifold sheets 14, 15, a damper sheet 13, a cover sheet 12, and a nozzle sheet 11, in an order from top toward bottom in FIG. 5, and those sheet members are stacked on each other. In the present embodiment, the eight sheets 11 through 18 of the channel unit 4 are formed of a same metal, such as an electrically conductive stainless steel.

The actuator unit 21, described in more detail later, includes two electrically insulating layers 22, 23 (see FIG. 7) and two piezoelectric sheets 24, 25 that are stacked on each other. One 24 of the four sheets 22 through 25 include a plurality of active portions (thus, the layer 24 will be referred to as the active sheet 24, where appropriate); and the other three sheets 22, 23, 25 do not include any active portions (thus, the sheets 22, 23, 25 will be referred to as the non-active sheets 22, 23, 25, where appropriate). Though the single active sheet 24 is employed in the present embodiment, two or more active sheets may be employed depending upon a required displacement amount of the actuator unit 21.

As shown in FIGS. 5 and 6, the nozzle sheet 11 has a plurality of ink-ejection nozzles 8 that are formed at a regular interval of distance corresponding to a recording resolution of the inkjet recording head 1 and each have a small diameter. More specifically described, the nozzles 8 are arranged in five arrays in a staggered manner in a lengthwise direction of the nozzle sheet 11.

As shown in FIG. 5, the cavity sheet 18 has, in a central portion thereof a plurality of pressure chambers 10 that are arranged in five arrays in a staggered manner in the lengthwise direction of the cavity sheet 18. In addition, the cavity sheet 18 has, in a lengthwise end portion thereof, four through-holes 35 that are spaced from each other in a widthwise direction of the cavity sheet 18 and define the four ink inlets 4*a* of the cavity unit 4, respectively. Each of the pressure chambers 10 has an elongate, substantially rectangular shape whose corners are rounded. A lengthwise direction of each pressure chamber 10 is perpendicular to the lengthwise direction of the cavity sheet 18. As shown in FIGS. 5 and 6, each of the supply sheet 17, the aperture sheet 16, the two manifold sheets 14, 15, the damper sheet 13, and the cover sheet 12 has a plurality of through-holes 31 that are arranged in five arrays in a staggered manner in the lengthwise direction of the each sheet and each have a small diameter. Each of the pressure chambers 10 communicates, at one of lengthwise opposite end portions thereof, with a corresponding one of the ink-ejection nozzles 8 via the corresponding through-holes 31 of the six sheets 17, 16, 15, 14, 13, 12.

As shown in FIG. 5, one 15 of the two manifold sheets 15, 14 that is adjacent to the aperture sheet 16 has five first half manifold chambers 19*a* that are formed through a thickness of the sheet 15. The five first half manifold chambers 19*a* extend in a lengthwise direction of the manifold sheet 15, and are spaced from each other in a widthwise direction thereof.

The other manifold sheet 14 located adjacent to the damper sheet 13 has five second half manifold chambers 11*b* that are formed through a thickness of the sheet 14 and are similar in shape to the five first half manifold chambers 19*a*. As shown in FIG. 6, in a state in which the two manifold sheets 15, 14, the aperture sheet 16, and the damper sheet 13 are stacked on each other, the five first half manifold chambers 19*a* and the five second half manifold chambers 19*b* are opposed to each other, and cooperate with each other to define five full manifold chambers 5. In this state, respective upper open ends of the five manifold chambers 5 are closed by the aperture sheet 16; and respective lower open ends of the five manifold chambers 5 are closed by the damper sheet 13. One of the five manifold chambers 5 is located outside the five arrays of through-holes 31 of the manifold sheets 15, 14, and the other, four manifold chambers 5 are located among the five arrays of through-holes 31. The five manifold chambers 5 communicate, at respective one end portions thereof, with the four ink inlets 4*a*, respectively.

The supply sheet 17 has, in addition to the five arrays of through-holes 31 thereof, a plurality of communication holes 32 that are formed through a thickness of the sheet 17 and are arranged in five arrays in a staggered manner in the lengthwise direction of the sheet 17 such that the communication holes 32 correspond to the pressure chambers 10, respectively. Each of the communication holes 32 communicates, at one of opposite end portions thereof, with a corresponding one of the pressure chambers 10 and, at the other end portion thereof, with a corresponding one of a plurality of apertures 33, described below, of the aperture sheet 16. In addition, the supply sheet 17 has, in a lengthwise end portion thereof, four though-holes 36 (see FIG. 5) that communicate with the four through-holes 35 of the cavity sheet 18, respectively.

The aperture sheet 16 has, in addition to the five arrays of through-holes 31 thereof, a plurality of apertures 33 which are arranged in five arrays in a staggered manner in the lengthwise direction of the sheet 16 and each of which extends in a widthwise direction of the sheet 16 and has a substantially rectangular shape in its plan view. Each of the apertures 33 communicates, at one of opposite end portions thereof, with a corresponding one of the communication holes 32 of the supply sheet 17 and, at the other end portion thereof, with a corresponding one of the five manifold chambers 5. Since each of the apertures 33 has a considerably small cross section area as taken along a plane perpendicular to the direction of flow of ink therein, the each aperture 33 can effectively prevent the ink from flowing back from the corresponding pressure chamber 10 to the corresponding manifold 5 when a droplet of the ink is ejected from the corresponding nozzle 8. In addition, the aperture sheet 16 has four through-holes 37 each of which communicates, at an upper end thereof with a corresponding one of the four through-holes 35 of the cavity sheet 18 via a corresponding one of the four through-holes 36 of the supply sheet 17 and, at a lower end thereof, with one end portion of a corresponding one of the five manifold chambers 5.

More specifically described, the largest one 37 of the four through-holes 37 communicates with two manifold chambers 5 out of the five manifold chambers 5, and the other three through-holes 37 communicate with the other three manifold chambers 6, respectively. Thus, the two manifold chambers 5 that communicate with the largest through-hole 37 receive the black ink via one of the four ink inlets 4*a*; and the other three manifold chambers 5 that communicate with the other three through-holes 37 receive the cyan, yellow, and magenta inks via the other three ink inlets 4*a*, respectively.

As shown in FIGS. 5 and 6, the damper sheet 13 has five damper grooves 38 that do not extend through a thickness of the sheet 13. More specifically described, the five damper grooves 38 open toward the cover sheet 12, but do not open toward the manifold sheet 14. The five damper grooves 38 have respective shapes similar to those of the five manifold chambers 5, and are opposed to the same 6, respectively. Thus, in a state in which the two manifold sheets 15, 14 and the damper sheet 13 are bonded to each other, five damper portions 39 as respective bottom walls of the five damper grooves 38 are opposed to the five manifold chambers 5, respectively. Since the five damper portions 39 are each formed of the stainless steel that is elastically deformable by an appropriate amount, the each damper portion 39 can freely vibrate upward and downward, i.e., toward a corresponding one of the five manifold chambers 5 and a corresponding one of the five damper grooves 38. Owing to this arrangement, even if the pressure changes produced in each of the pressure chambers 10 upon ejection of ink may be propagated backward to the corresponding manifold chamber 5, those pressure chambers can be effectively absorbed and attenuated by the elastic deformation of the corresponding damper portion 39.

Since the channel unit 4 is constructed as described above, the channel unit 4 has the four groups of ink channels corresponding to the four inks, respectively, and each of the ink channels includes a corresponding one of the four ink inlets 4*a*, a corresponding one of the five manifold chambers 5, a corresponding one of the apertures 33, a corresponding one of the communication holes 32, a corresponding one of the pressure chambers 10, corresponding ones of the through-holes 31, and a corresponding one of the nozzles 8. After each of the four inks flows into the channel unit 4 via a corresponding one of the four ink inlets 4*a*, the each ink is temporarily stored by one or two corresponding manifold chambers 5; and then, the each ink is supplied to the nozzles 8 of one or two corresponding arrays via the apertures 33 of one or two corresponding arrays. When the ink present in each of the pressure chambers 10 is pressed by the actuator unit 21, a droplet of the ink is ejected from a corresponding one of the nozzles via corresponding ones of the through-holes 31.

Figure 7:
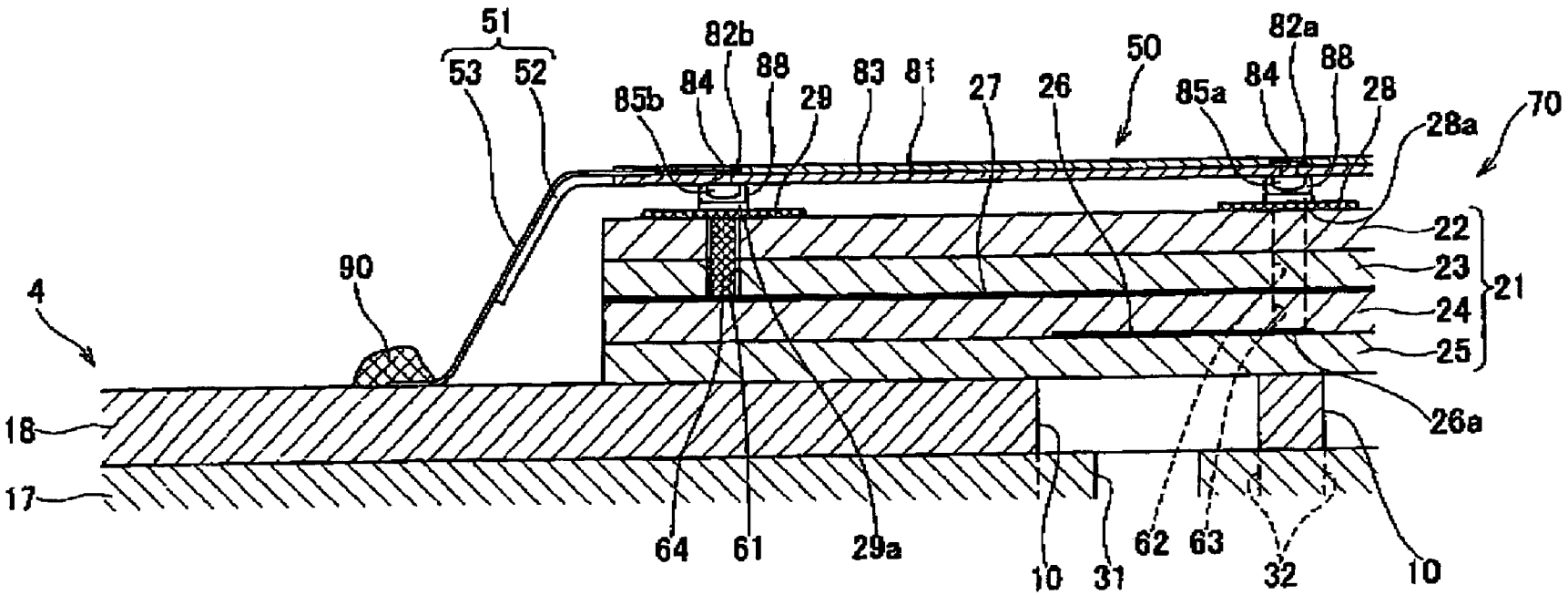
FIG. 7 is an enlarged view of a portion of the inkjet recording head, indicated at one-dot chain line in FIG. 6.

Next, the actuator unit 21 will be described by reference to FIGS. 7 and 8. As shown in FIG. 7, the actuator unit 21 is constituted by the two electrically insulating sheets 22, 23 and the two piezoelectric sheets 24, 25 that are stacked on each other. On an upper surface of the piezoelectric sheet 25, a plurality of individual electrodes 26 (only one electrode 26 is shown in FIG. 7) are formed such that the individual electrodes 26 are opposed to the pressure chambers 10 of the channel unit 4, respectively. The individual electrodes 26 are arranged in five arrays, in a staggered manner, in a lengthwise direction of the piezoelectric sheet 25, such that the five arrays of individual electrodes 26 correspond to the five arrays of pressure chambers 10, respectively. Each of the individual electrodes 26 is elongate in a widthwise direction of the piezoelectric sheet 25, and includes an extension portion 26*a* that is extended from one of lengthwise opposite ends thereof generally in the lengthwise direction of the sheet 25, to a position where the extension portion 26*a* is opposed to a partition wall of the cavity sheet 18 that separates two adjacent pressure chambers 10 from each other.

On an upper surface of the piezoelectric sheet 24, a common electrode 27 is provided such that the common electrode 27 is opposed to each of the pressure chambers 10. The common electrode 27 has a plurality of openings, not shown, that are opposed to the respective extension portions 26*a* of the individual electrodes 26 and thereby prevent conductors 64 that are provided in through-holes 63 and are connected the respective extension portions 26*a* of the individual electrodes 26, from electrically connecting the individual electrodes 26 to the common electrode 27. In this arrangement, the individual electrodes 26 cooperate with the common electrode 27 to sandwich a plurality of active portions of the piezoelectric sheet 24 that correspond to the pressure chambers 10, respectively. Thus, the piezoelectric sheet 24 is an active sheet; and the other piezoelectric sheet 25 and the two insulating sheets 22, 23 are inactive sheets.

On an upper surface of the top insulating sheet 22 (i.e., on an upper surface of the actuator unit 21), there are provided a plurality of first surface electrodes 28 that are connected to the individual electrodes 26, respectively, and a second surface electrode 29 that is connected to the common electrode 27. As shown in FIG. 8, the first surface electrodes 28 are located such that the first surface electrodes 28 are opposed to the partition walls of the cavity sheet 18, respectively, each one of which separates two adjacent pressure chambers 10 from each other. The first surface electrodes 28 are arranged in five arrays, in a staggered manner, in a lengthwise direction of the actuator unit 21, such that the five arrays of first surface electrodes 28 correspond to the five arrays of individual electrodes 26, respectively. Each of the first surface electrodes 28 is elongate in a widthwise direction of the actuator unit 21, and has a rectangular, flat shape. A land 28*a* is provided on one of lengthwise opposite end portions of each first surface electrode 28, and is electrically connected to the FPC 50. The lands 28*a* are arranged in a staggered manner on each array of first surface electrodes 28.

Figure 8:
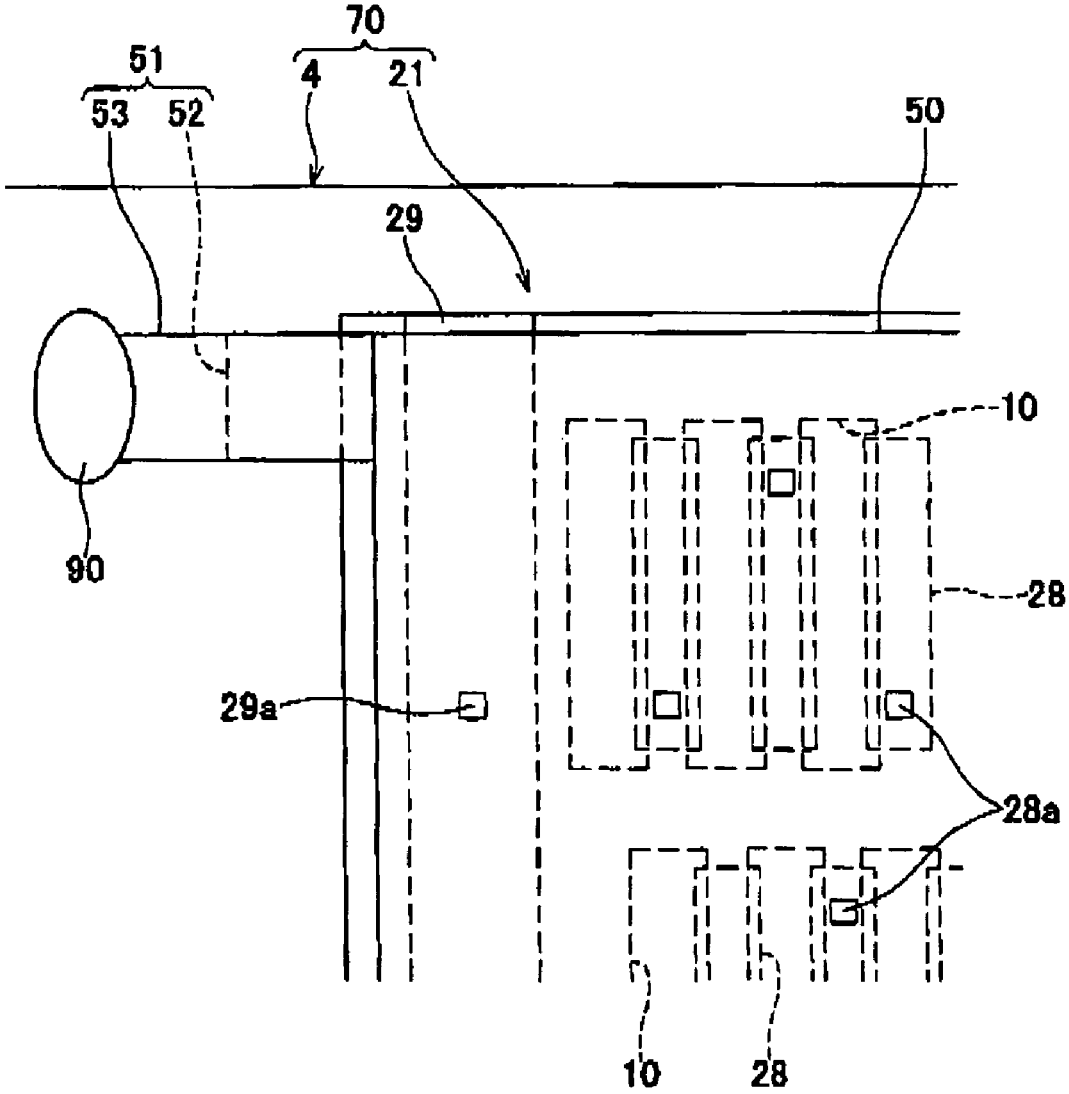
FIG. 8 is an enlarged plan view of the main body of the inkjet recording head, shown in FIG. 4.

As shown in FIG. 8, the second surface electrode 29 is provided on one of lengthwise opposite end portions of the insulating sheet 22, and extends in a widthwise direction of the sheet 22. A plurality of lands 29*a* (only one land 29*a* is shown in FIG. 8) are provided on the second surface electrode 29, and are electrically connected to the FPC 50.

The insulating sheets 22, 23 have a plurality of through-holes 61 that are opposed to the lands 29*a*, respectively; and a plurality of through-holes 62 that are opposed to the lands 28*a*, respectively. As described above, the piezoelectric sheet 24 has the through-holes 63 that communicate with the through-holes 62, respectively. A conductor 64 is provided in each of the through-holes 61, 62, 63. Thus, the second surface electrode 29 is electrically connected to the common electrode 27; and the first surface electrodes 28 are electrically connected to the individual electrodes 26, respectively, via the respective extension portions 26*a* thereof.

The FPC 50 is connected to the upper portion of the actuator unit 21 such that the FPC 50 is positioned relative to the respective lands 28*a*, 29*a* of the first and second surface electrodes 28, 29. The FPC 50 includes a base film 81 as an electrically insulating flexible layer; first and second electrical conductors 82*a*, 82*b* that are formed on an upper surface of the base film 81; and a cover film 83 that substantially entirely covers the base film 81. The FPC 50 includes the protruding portion 51 that protrudes from one side of the free end portion thereof toward the channel unit 4. As shown in FIG. 7, the protruding portion 51 includes a projection portion 52 as a support portion that projects from the base film 81; and an extension portion 53 as a connection portion that extends from the second conductor 82*b* as a grounding wire, along the projection portion 52, such that about half the extension portion 53 that is located between its base end and its middle portion is supported by the projection portion 52. Since no portion of the cover film 83 is formed on the protruding portion 53, an upper surface of the extension portion 53 is exposed.

As shown in FIGS. 7 and 8, a free end portion of the extension portion 53 is held in direct contact with the upper surface of the cavity sheet 18 of the channel unit 4. A non-conductive adhesive 90 is applied to the free end portion of the extension portion 53, such that the adhesive 90 covers an entire upper surface of the free end portion of the extension portion 53, and overflows the upper surface of the free end portion. Owing to this feature, the free end portion of the extension portion 63 is reliably fixed to the upper surface of the cavity sheet 18, and the channel unit 4 is electrically connected to the second conductor 82*b* via the extension portion 53.

The base 81 has a plurality of through-holes 84 that correspond to the first and second conductors 82*a*, 82*b* such that respective middle portions of the conductors 82*a*, 82*b* are exposed through the respective through-holes 84. That is, the base film 81, the first and second conductors 82*a*, 82*b*, and the cover film 83 are stacked on each other, such that respective centers of the through-holes 84 are aligned with the respective centers of the conductors 82*a*, 82*b*, and such that respective outer peripheral portions of the conductors 82*a*, 82*b* are covered by the base film 81 and the cover film 83.

The FPC 50 has first and second terminals 85*a*, 85*b* that are connected to the corresponding first and second conductors 82*a*, 82*b* via the respective through-holes 84. The first and second terminals 85*a*, 85*b* are each formed of an electrically conductive material such as nickel. The first and second terminals 85*a*, 85*b* close the respective through-holes 84, cover respective annular portions of the base film 81 that define the respective through-holes 84, and project downward from a lower surface of the base film 81. The first and second terminals 85*a*, 85*b* are electrically connected to the corresponding lands 28*a*, 29*a* through solder 88.

The first and second conductors 82*a*, 82*b* are each formed of a copper foil. Each of the first and second conductors 82*a*, 82*b* is formed on the upper surface of the base film 81, such that the each conductor 82*a*, 82*b* has a predetermined shape. In the present embodiment, the first conductors 82*a* as individual wires are connected, at respective one ends thereof, to the respective individual electrodes 26, and are connected, at respective other ends thereof, to the driver IC 75, so that the individual electrodes 26 are connected to the driver IC 75 via the respective lands 28*a* of the first surface electrodes 28 and the respective first terminals 85*a*. In addition, the second conductor 82*b* as the grounding wire is connected, at one end thereof, to the common electrode 27 and the channel unit 4, and is connected, at the other end thereof, to the ground, so that the common electrode 27 and the channel unit 4 are connected to the ground via the lands 29*a* of the second surface electrode 29 and the second terminals 85*b*. Owing to this arrangement, the driver IC 75 can apply a drive voltage (i.e., a drive signal) to an arbitrary one of the individual electrodes 26, and the common electrode 27, while keeping the common electrode 27 at the ground potential. Simultaneously, like the common electrode 27 having the large area in the actuator unit 21, the channel unit 4 is also kept at the ground potential. Thus, one of the active portions of the piezoelectric layer 24 that corresponds to a desired one of the individual electrodes 26 is deformed in a direction of stacking of the sheets 22 through 25 of the actuator unit 21, so that a droplet of ink is ejected from one of the nozzles 8 that corresponds to the desired individual electrode 26 and eventually a desired printing or recording is performed on the recording sheet.

As is apparent from the foregoing description of the inkjet recording head 1, the cavity sheet 18 of the channel unit 4 is electrically connected to the extension portion 53 of the FPC 50. Therefore, unlike the conventional inkjet recording head disclosed by the previously-indicated patent document, it is not needed to use a large amount of electrically conductive adhesive, for the purpose of preventing the shortcircuiting of the individual electrodes 26. In addition, in the inkjet recording head 1, the FPC 50 includes the protruding portion 51. Therefore, unlike the conventional inkjet recording head, it is not needed to employ a step of controlling the shape of the large amount of electrically conductive adhesive. This leads to reducing the production cost of the inkjet recording head 1. Moreover, in the inkjet recording head 1, the channel unit 4 is electrically connected to the extension portion 53. Therefore, even if the electric charges of the electrified recording sheet may flow to the channel unit 4, those electric charges eventually flow to the ground via the extension portion 53 of the FPC 50. More specifically described, the electric charges flow to the ground via the second conductor 82*b* of the FPC 50 while bypassing the driver IC 75. Thus, the driver IC 75 is prevented from being electrically damaged by those electric charges.

In the inkjet recording head 1, the common electrode 27 and the channel unit 4 are electrically connected to the second conductor 82*b*. Therefore, even if the electrified recording sheet may contact the channel unit 4, no electric potential difference is produced between the channel unit 4 and the common electrode 27. Thus, the actuator unit 21 is prevented from being damaged by the potential difference. More specifically described, the inks used with the inkjet recording head 1 contain water, and electrically conductive components that produce ionic components when being electrolyzed.

Therefore, if an electric potential difference is produced between the common electrode 27 and the channel unit 4, then the inks present in the pressure chambers 10 may be electrolyzed, and the ionized conductive components of the inks may penetrate into the piezoelectric sheets 24, 25 present between the channel unit 4 and the common electrode 27, so that the individual electrodes 26 may be shortcircuited and/or the constituent elements (e.g., lead, titanium, or zinc) of the piezoelectric sheets 24, 25 may chemically react with the ionized conductive components and thereby erode the sheets 24, 25. In addition, if the amount of electric charges with which the piezoelectric sheets 24, 25 are electrified is too large relative to the respective thickness, or respective withstand voltages, of the sheets 24, 25, then the sheets 24, 25 may be damaged. However, in the inkjet recording head 1, the channel unit 4 and the common electrode 27 are both grounded, as described above. Thus, the present inkjet recording head 1 is free of the above-described problems.

The channel unit 4 is constituted by the electrically conductive, metal sheets 11 through 18 that are stacked on each other. Thus, the channel unit 4 as a whole is electrically conductive. Owing to this arrangement, even if the channel unit 4 may be contacted with the electrified recording sheet and accordingly be electrified, the channel unit 4 as a whole can be kept at the same electric potential as that of the common electrode 27, and no electric potential differences are produced in the channel unit 4. Thus, the channel unit 4 is free of adverse influences from the electric potential differences produced therein and, since the channel unit 4 as a whole is kept at the ground potential, the drive IC 75 can be reliably prevented from being shortcircuited.

Since the free end portion of the extension portion 53 of the second conductor 82*b* is held in direct contact with the upper surface of the channel unit 4 (i.e., the upper surface of the cavity unit 18), the non-conductive adhesive 90 can be used. In addition, the free end portion of the extension portion 53 of the second conductor 82*b* extends over the projection portion 52, the free end portion of the protruding portion 51 is constituted by the free end portion of the extension portion 58 only. Therefore, irrespective of the manner in which the FPC 60 is connected to the actuator unit 12 (e.g., the FPC 50 is connected upside down), the free end portion of the extension portion 63 can be easily contacted with the channel unit 4. More specifically described, if the entire length of the extension portion 63 is supported by the projection portion 62, the free end portion of the extension portion 53 cannot be directly contacted with the upper surface of the channel unit 4. In contrast, in the present embodiment, the free end portion of the extension portion 53 extends over the projection portion 52, the free end portion of the extension portion 53 can be easily contacted with the channel unit 4. Moreover, since the adhesive 90 is used to fix the free end portion of the extension portion 53 to the channel unit 4, the channel unit 4 is electrically connected to the second conductor 82*b* with improved reliability. In addition, since the adhesive 90 is applied to not only the upper surface of the free end portion of the extension portion 53 but also a portion of the upper surface of the channel unit 4, the free end portion of the extension portion 53 are strongly fixed to the channel unit 4. Therefore, the channel unit 4 is electrically connected to the second conductor 82*b* with still improved reliability.

Figure 9:
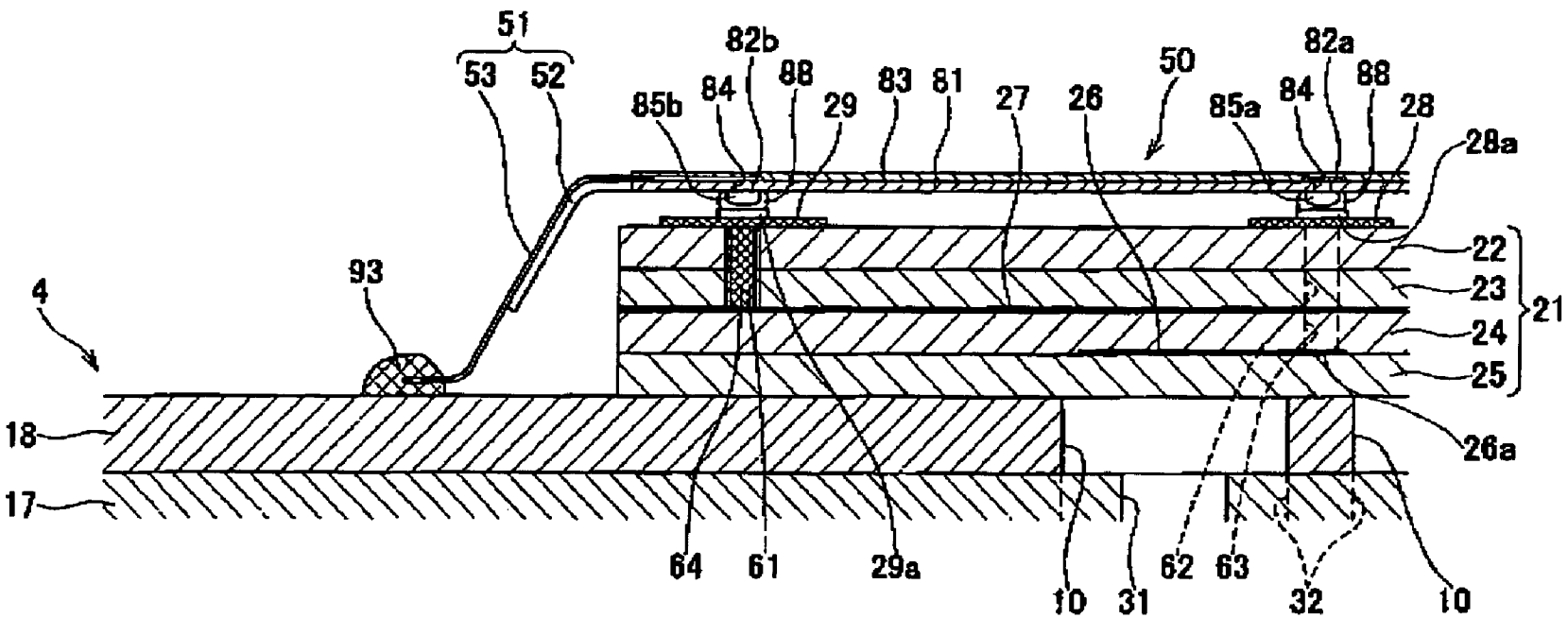
FIG. 9 is an enlarged cross-section view corresponding to FIG. 7, showing another inkjet recording head as a second embodiment of the present invention.
Figure 10A:
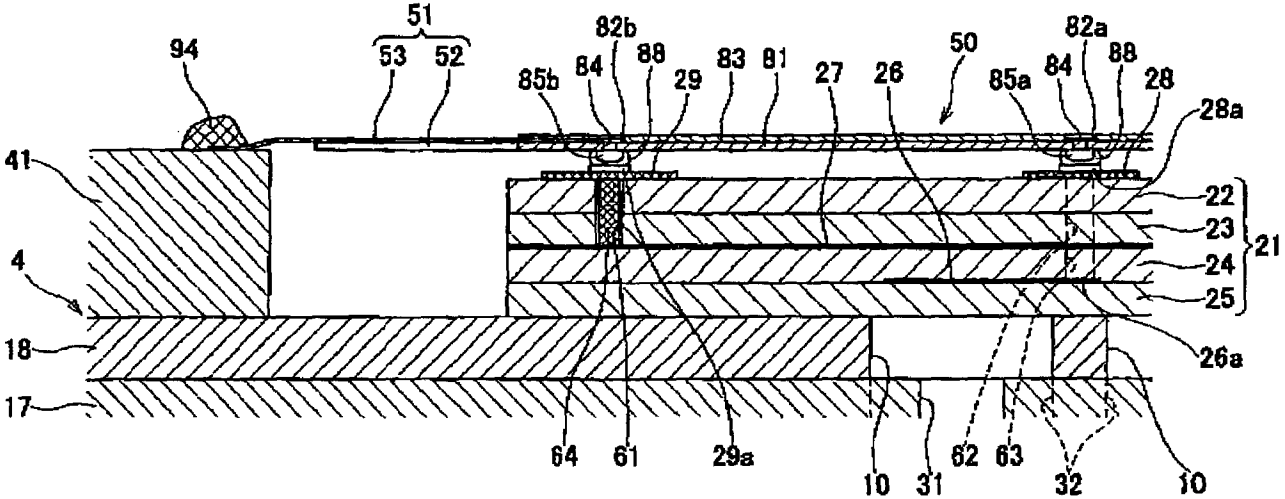
FIG. 10A is an enlarged cross-section view corresponding to FIG. 7, showing another inkjet recording head as a third embodiment of the present invention.
Figure 10B:
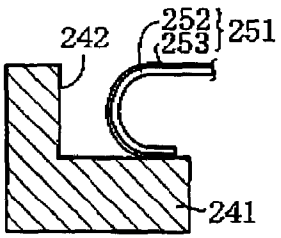
FIG. 10B is an enlarged cross-section view corresponding to FIG. 10A, showing another inkjet recording head as a modified form of the third embodiment of the present invention.
Figure 10C:
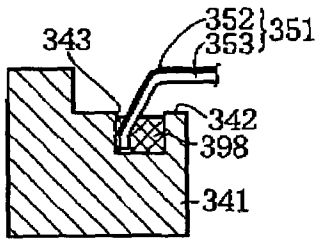
FIG. 10C is an enlarged cross-section view corresponding to FIG. 10A, showing another inkjet recording head as another modified form of the third embodiment of the present invention.

In the first embodiment shown in FIGS. 1 through 8, the free end portion of the extension portion 53 of the second conductor 82*b* formed in the FPC 50 is directly contacted with the channel unit 4. However, in an inkjet recording head as a second embodiment shown in FIG. 9, the free end portion of the extension portion 53 of the second conductor 82*b* is not directly contacted with the channel unit 4. The same reference numerals as used in the first embodiment are used to designate the corresponding elements of the second embodiment, and the description thereof is omitted. This is true with the following embodiments shown in FIGS. 10A, 10B, 10C, 11, 12, and 13. In the second embodiment, the free end portion of the extension portion 53 is distant from the cavity sheet 18, and an electrically conductive adhesive 93 is used to cover the entirety of the free end portion of the extension portion 53 and thereby fix the extension portion 53 to the cavity sheet 18. Owing to this arrangement, the channel unit 4 is electrically connected to the second conductor 82*b*. Therefore, in the second embodiment, too, the extension portion 53 of the second conductor 82*b* can be strongly fixed to the channel unit 4, and the shortcircuiting of the individual electrodes 26 can be prevented.

In the first embodiment, the free end portion of the extension portion 53 of the second conductor 82*b* formed in the FPC 50 is fixed to the channel unit 4. However, in an inkjet recording head as a third embodiment shown in FIG. 10A, the free end portion of the extension portion 53 of the second conductor 82*b* is fixed to the electrically conductive frame 41, and is electrically connected to the channel unit 4 via the frame 41. In the third embodiment, the protruding portion 51 of the FPC 60 protrudes toward the frame 41, i.e., in a leftward direction in FIG. 10A, the free end portion of the extension portion 53 is held in direct contact with an upper surface of the frame 41, and a non-conductive adhesive 94 is used to fix the extension portion 53 to the frame 41. The present inkjet recording head can enjoy the same advantages as those of the inkjet recording head 1. However, the free end portion of the extension portion 53 may be kept distant from the frame 41, like the second embodiment shown in FIG. 9. In this case, an electrically conductive adhesive is used to fix the free end portion of the extension portion 53 to the frame 41, like the second embodiment. In the third embodiment, it is not needed to bend the extension portion 53, and accordingly the extension portion 53 can be considerably freely fixed to the frame 41. Owing to this arrangement, the free end portion of the extension portion 63, fixed to the frame 41, is not subjected to any adverse external forces. Thus, the extension portion 53 can be electrically connected to the frame 41 with improved reliability.

In the first embodiment, the free end portion of the extension portion 53 of the second conductor 82*b* formed in the FPC 60 extends over the projection portion 52 of the base film 81. However, in each of three inkjet recording heads as fourth, fifth, and sixth embodiments shown in FIGS. 11, 12, and 13, an entirety of an extension portion 153, 253, 353 of the second conductor 82*b* is supported by a projection portion 152, 252, 352 of the base film 81, so that the second conductor 82*b* is electrically connected to the channel unit 4 via the extension portion 153, 253, 353.

Figure 11:
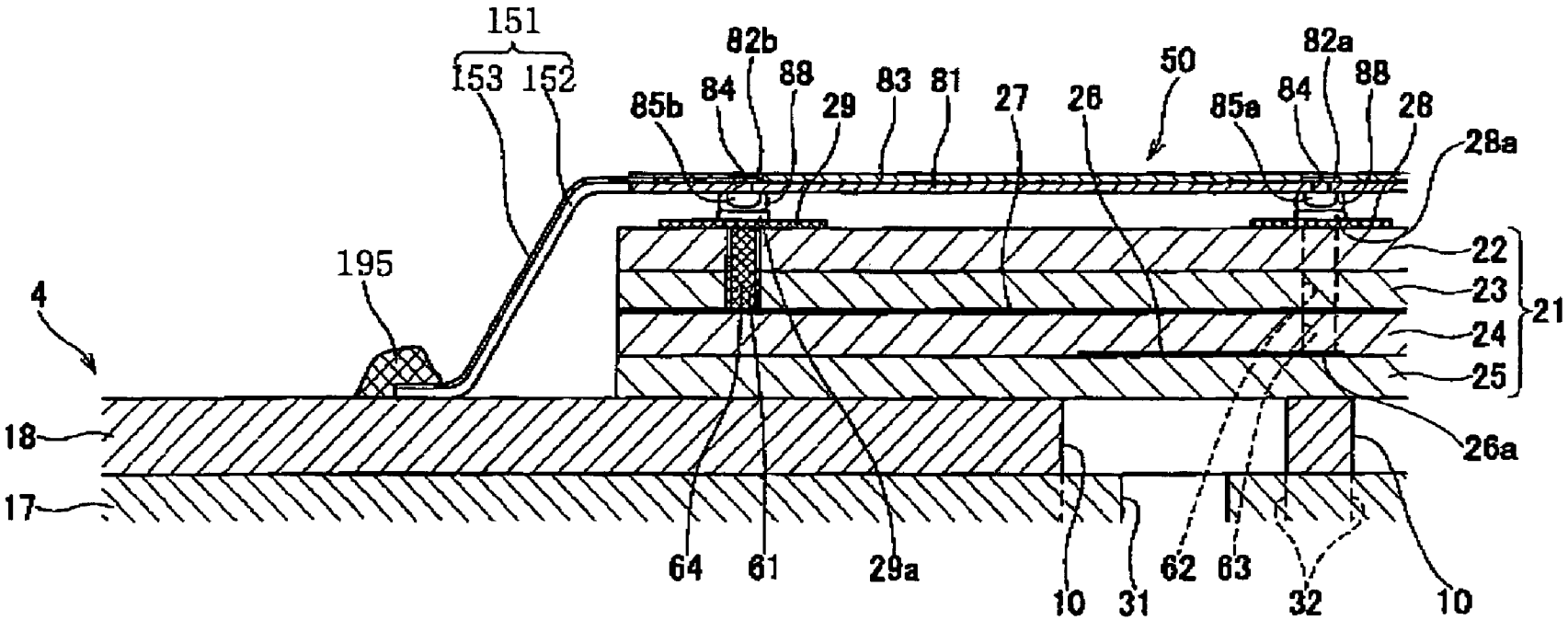
FIG. 11 is an enlarged cross-section view corresponding to FIG. 7, showing another inkjet recording head as a fourth embodiment of the present invention.

More specifically described, in the fourth embodiment shown in FIG. 11, the entirety of the extension portion 153 of the second conductor 82*b* is supported by the projection portion 152 of the base film 81 of the FPC 50, and a free end portion of the projection portion 152 is contacted with the upper surface of the channel unit 4, and an electrically conductive adhesive 195 is used to fix a free end portion of the protruding portion 151 to the channel unit 4. The adhesive 195 is applied to cover an upper surface of the free end portion of the protruding portion 151, more specifically, a free end portion of the extension portion 153. Owing to this arrangement, the channel unit 4 and the second conductor 82*b* are electrically connected to each other via the adhesive 195 and the extension portion 153. Thus, the present inkjet recording head can enjoy the same advantages as those of the inkjet recording head 1. Since the extension portion 153 is entirely supported by the projection portion 152, the extension portion 153 can enjoy improved mechanical strength, and accordingly can be electrically connected to the channel unit 4 with improved reliability.

Figure 12:
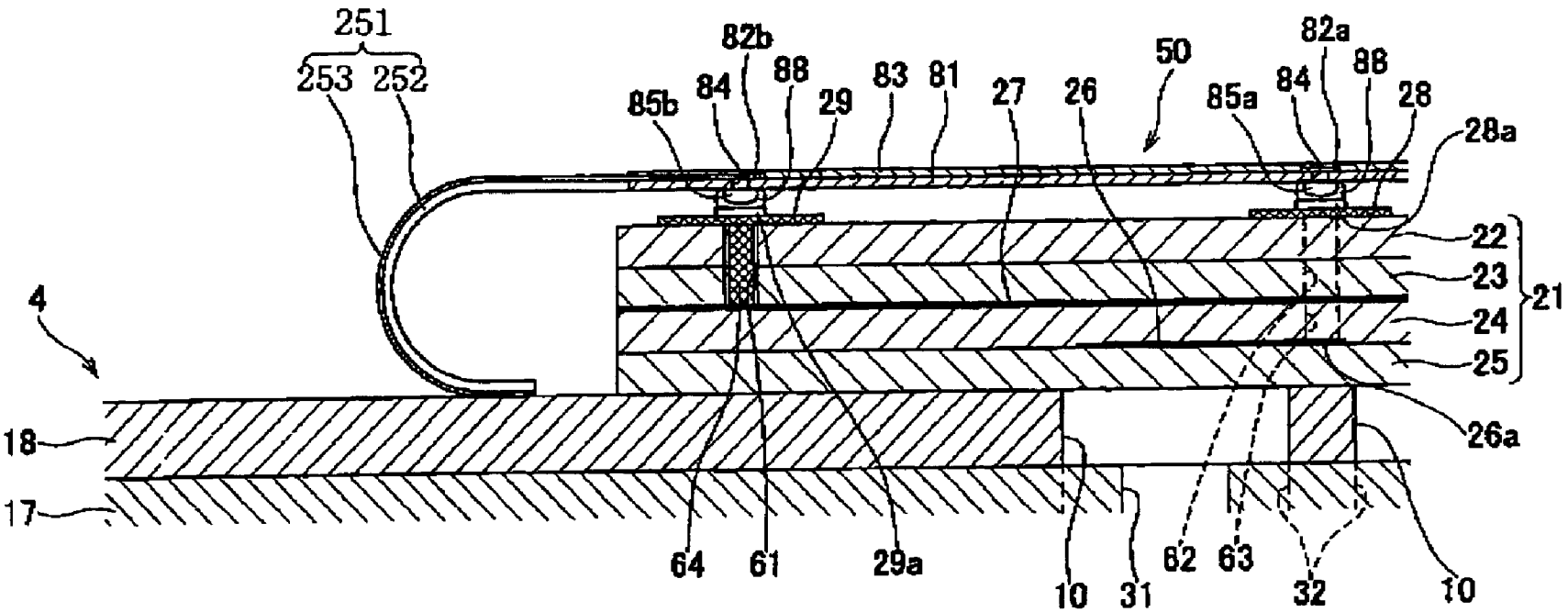
FIG. 12 is an enlarged cross-section view corresponding to FIG. 7, showing another inkjet recording head as a fifth embodiment of the present invention.

In the inkjet recording head as the fifth embodiment shown in FIG. 12, the entirety of the extension portion 253 of the second conductor 82*b* is supported by the projection portion 252 of the base film 81 of the FPC 50, and a free end portion of a protruding portion 251 is curved to have a U-shaped cross section, so that a free end portion of the extension portion 253 is contacted with the upper surface of the channel unit 4. Since the free end portion of the protruding portion 251 is curved to have the U-shaped cross section, the free end portion of the extension portion 253 is pressed against the channel unit 4 by an elastic, restoring force of the projection portion 252. Thus, the second conductor 82*b* is electrically connected to the channel unit 4 via the extension portion 253. Owing to this arrangement, the extension portion 253 can be electrically connected to the channel unit 4 without using any special elements such as an adhesive. This leads to reducing the production cost of the present inkjet recording head. Since the protruding portion 251 is curved to have the U-shaped cross section, the free end portion of the extension portion 253 can be easily curved. In addition, since the protruding portion 251 being curved is attached to the channel unit 4, the free end portion of the extension portion 253, contacted with the channel unit 4, is pressed by the pressing force produced by the curved protruding portion 251. Thus, the extension portion 253 can be electrically connected to the channel unit 4 with improved reliability.

Figure 13:
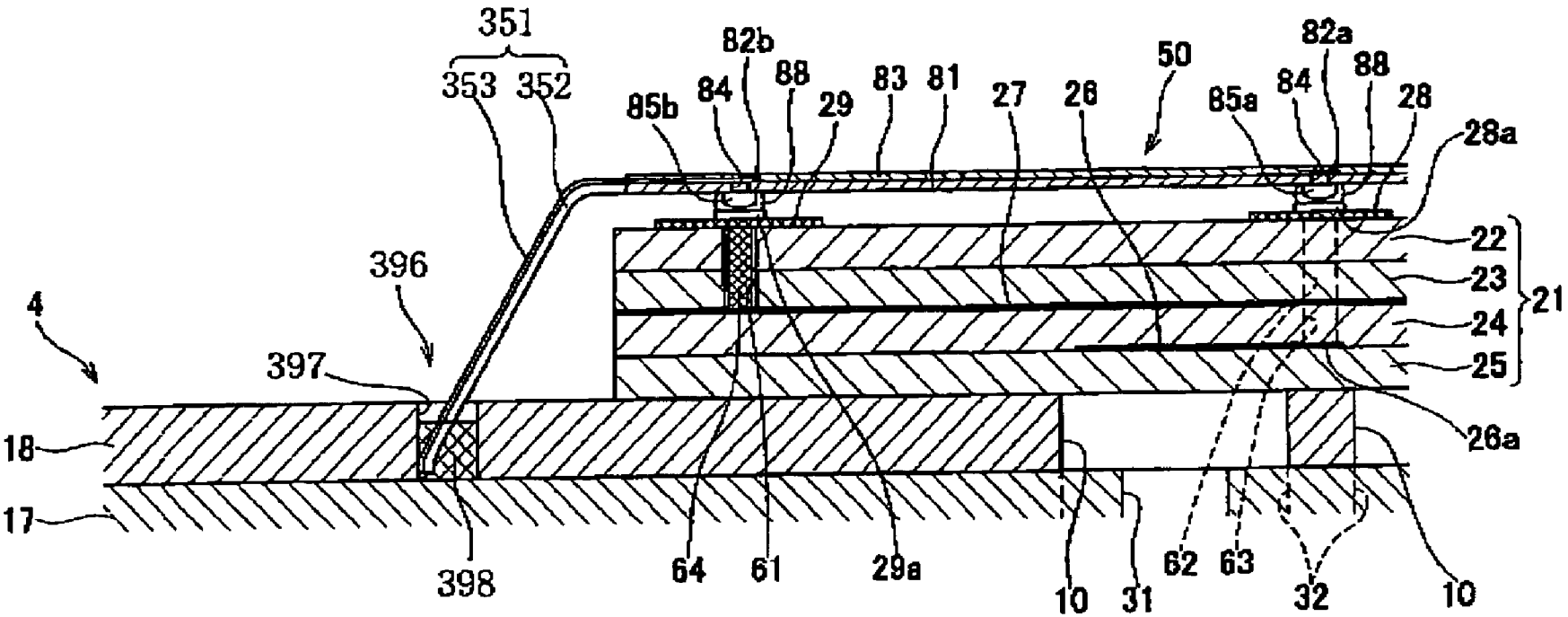
FIG. 13 is an enlarged cross-section view corresponding to FIG. 7, showing another inkjet recording head as a sixth embodiment of the present invention.

In the inkjet recording head as the sixth embodiment shown in FIG. 13, the entirety of the extension portion 353 of the second conductor 82*b* is supported by the projection portion 362 of the base film 81 of the FPC 50, and a free end portion of a protruding portion 351 is located in a recess 396 that is formed in the upper surface of the channel unit 4 at a position between the actuator unit 21 and the ink inlets 4*a*. The recess 396 is formed in such a manner that a through-hole 397 is formed through a thickness of the cavity sheet 18 and a lower open end of the through-hole 397 is closed by an upper surface of the supply sheet 17. The free end portion of the protruding portion 351, located in the recess 396, is fixed with an electrically conductive adhesive 398 to the channel unit 4, in a state in which an outer surface of a free end portion of the extension portion 353 is held in contact with an inner wall surface of the recess 396. Thus, the second conductor 82*b* is electrically connected to the channel unit 4 with improved reliability. In the present embodiment, the electrically conductive adhesive 898 may be replaced with a non-conductive adhesive, because the outer surface of the free end portion of the extension portion 353 is held in direct contact with the inner wall surface of the recess 396. In addition, the conductive or non-conductive adhesive may be omitted because the free end portion of the protruding portion 351, located in the recess 396, hardly comes off the recess 396 and an elastic restoring force applied by the projection portion 352 to the extension portion 353 in an upward direction presses the outer surface of the free end portion of the extension portion 353 against the inner wall surface of the recess 396.

In each of the fourth, fifth, and sixth embodiments shown in FIGS. 11, 12, and 13, the second conductor 82*b* may be electrically connected to the frame 41, i.e., may be electrically connected to the channel unit 4 via the frame 41. For example, in an inkjet recording head shown in FIG. 10B, the protruding portion 251 of the FPC 50 that includes the projection portion 252 and the extension portion 253 is electrically connected to a recess 242 of a frame 241 that is electrically connected, like the frame 41, to the channel unit 4; and in an inkjet recording head shown in FIG. 10C, the protruding portion 351 of the FPC 50 that includes the projection portion 352 and the extension portion 353 is electrically connected with an electrically conductive, or non-conductive, adhesive 398 to a hole 343 formed in a recess 342 of a frame 341 that is electrically connected, like the frame 41, to the channel unit 4. In the modified embodiments shown in FIGS. 10B and 10C, the inkjet recording heads can enjoy the same advantages as the above-described advantages of the inkjet recording head 1 and the inkjet recording heads shown in FIGS. 12 and 13

While the present invention has been described in its preferred embodiments, it is to be understood that the present invention is not limited to the details of the described embodiments but may be embodied with various changes, modifications, and improvements that may occur to a person skilled in the art without departing from the spirit and scope of the invention defined in the appended claims. For example, in the inkjet recording head 1 as the first embodiment, the free end portion of the extension portion 53 of the second conductor 82*b* is fixed with the adhesive 90 to the channel unit 4. However, the adhesive 90 may be omitted so long as the free end portion of the extension portion 53 is held in direct contact with the channel unit 4. In addition, the inkjet recording head 1 as the first embodiment is driven by the piezoelectric actuator unit 21 so as to eject the droplets of inks from the nozzles 8. However, the principle of the present invention is applicable to an inkjet recording head of a different sort wherein ink present in each pressure chamber is heated by an actuator (e.g., a heater) that is driven by an electric signal supplied from the FPC 50, and thus receives energy to eject a droplet of ink from a nozzle communicating with the each pressure chamber. In this case, the actuators corresponding to the pressure chambers, respectively, include the individual electrodes 26, respectively, that are electrically connected to the first terminals 85*a* of the FPC 50, and all the actuators are connected to the second conductor 82*b* as the grounding wire.

What is claimed is:

1. An inkjet recording head, comprising:

a channel unit including at least one electrically conductive member, and having a plurality of pressure chambers which communicate with a plurality of nozzles, respectively;

a plurality of individual electrodes which are associated with the plurality of pressure chambers, respectively; and a flexible flat cable including a plurality of individual wires which are electrically connected to the plurality of individual electrodes, respectively, a grounding wire which is held at a ground potential, and an electrically insulating flexible layer which supports the individual wires and the grounding wire, wherein the grounding wire includes an extension portion which is electrically connected to said at least one electrically conductive member of the channel unit, and the electrically insulating flexible layer includes a projection portion which supports at least a portion of the extension portion of the grounding wire.

2. The inkjet recording head according to claim 1, wherein the extension portion of the grounding wire and the projection portion of the electrically insulating flexible layer extend and project, respectively, in a lateral direction from a stem portion of the flexible flat cable toward the channel unit.

3. The inkjet recording head according to claim 1, further comprising:

a piezoelectric sheet which is opposed to each of the pressure chambers of the channel unit; and a common electrode which cooperate with each of the individual electrodes to sandwich a corresponding one of a plurality of active portions of the piezoelectric sheet, wherein the grounding wire is electrically connected to the common electrode.

4. The inkjet recording head according to claim 1, further comprising an adhesive which fixes the extension portion of the grounding wire to a surface of said at least one electrically conductive member of the channel unit.

5. The inkjet recording head according to claim 4, wherein the extension portion of the grounding wire is held in direct contact with the surface of said at least one electrically conductive member of the channel unit.

6. The inkjet recording head according to claim 1, wherein said at least one electrically conductive member of the channel unit has a recess formed in a surface thereof, and at least a portion of the extension portion of the grounding wire is located in the recess.

7. The inkjet recording head according to claim 6, further comprising an adhesive which is provided in the recess of said at least one electrically conductive member of the channel unit and fixes said portion of the extension portion of the grounding wire to the recess.

8. The inkjet recording head according to claim 1, wherein a portion of the extension portion of the grounding wire extends over the projection portion of the electrically insulating flexible layer, and said portion of the extension portion is electrically connected to said at least one electrically conductive member of the channel unit.

9. The inkjet recording head according to claim 8, further comprising an adhesive which fixes said portion of the extension portion of the grounding wire to said at least one electrically conductive member of the channel unit.

10. The inkjet recording head according to claim 9, wherein the adhesive includes a first portion which covers said portion of the extension portion of the grounding wire and a second portion which contacts said at least one electrically conductive member of the channel unit.

11. The inkjet recording head according to claim 1, wherein the projection portion of the electrically insulating flexible layer is elastically deformed to produce a biasing force which biases the extension portion of the grounding wire toward said at least one electrically conductive member of the channel unit, so that the extension portion is kept in contact with said at least one electrically conductive member.

12. The inkjet recording head according to claim 11, wherein the projection portion of the electrically insulating flexible layer is elastically curved to have a U-shaped cross section.

13. The inkjet recording head according to claim 1, further comprising a frame which includes at least one second electrically conductive member different from at least one first electrically conductive member as said at least one electrically conductive member of the channel unit, and which is fixed to the channel unit such that said at least one second electrically conductive member is electrically connected to said at least one first electrically conductive member, wherein the extension portion of the grounding wire is electrically connected to said at least one first electrically conductive member of the channel unit via said at least one second electrically conductive member of the frame.

14. The inkjet recording head according to claim 1, wherein the channel unit includes, as said at least one electrically conductive member, a first electrically conductive layer, and additionally includes at least one second electrically conductive layer which is stacked on the first electrically conductive layer.

15. An inkjet recording head, comprising:

a channel unit including at least one first electrically conductive member, and having a plurality of pressure chambers which communicate with a plurality of nozzles, respectively;

a frame which includes at least one second electrically conductive member and which is fixed to the channel unit such that said at least one second electrically conductive member is electrically connected to said at least one first electrically conductive member;

a plurality of individual electrodes which are associated with the pressure chambers, respectively; and a flexible flat cable including a plurality of individual wires that are electrically connected to the individual electrodes, respectively, a grounding wire which is held at a ground potential and an electrically insulating flexible layer which supports the individual wires and the grounding wire, wherein the grounding wire includes an extension portion which is electrically connected to said at least one second electrically conductive member of the frame, and the electrically insulating flexible layer includes a projection portion which supports at least a portion of the extension portion of the grounding wire.

16. The inkjet recording head according to claim 15, wherein the extension portion of the grounding wire and the projection portion of the electrically insulating flexible layer extend and project, respectively, in a lateral direction from a stem portion of the flexible flat cable toward the frame.

17. The inkjet recording head according to claim 15, further comprising:

a piezoelectric sheet which is opposed to each of the pressure chambers; and a common electrode which cooperate with each of the individual electrodes to sandwich a corresponding one of a plurality of active portions of the piezoelectric sheet, wherein the grounding wire is electrically connected to the common electrode.

18. The inkjet recording head according to claim 15, further comprising an adhesive which fixes the extension portion of the grounding wire to a surface of said at least one second electrically conductive member of the frame.

19. The inkjet recording head according to claim 18, wherein the extension portion of the grounding wire is held in direct contact with the surface of said at least one second electrically conductive member of the frame.

20. The inkjet recording head according to claim 15, wherein said at least one second electrically conductive member of the frame has a recess formed in a surface thereof, and at least a portion of the extension portion of the grounding wire is located in the recess.

21. The inkjet recording head according to claim 20, further comprising an adhesive which is provided in the recess of said at least one second electrically conductive member of the frame and fixes said portion of the extension portion of the grounding wire to the recess.

22. The inkjet recording head according to claim 15, wherein a portion of the extension portion of the grounding wire projects over the projection portion of the electrically insulating flexible layer, and said portion of the extension portion is electrically connected to said at least one second electrically conductive member of the frame.

23. The inkjet recording head according to claim 22, further comprising an adhesive which fixes said portion of the extension portion of the grounding wire to said at least one second electrically conductive member of the frame.

24. The inkjet recording head according to claim 23, wherein the adhesive includes a first portion which covers said portion of the extension portion of the grounding wire and a second portion which contacts said at least one second electrically conductive member of the frame.

25. The inkjet recording head according to claim 15, wherein the projection portion of the electrically insulating flexible layer is elastically deformed to produce a biasing force which biases the extension portion of the grounding wire toward said at least one second electrically conductive member of the frame, so that the extension portion is kept in contact with said at least one second electrically conductive member.

26. The inkjet recording head according to claim 25, wherein the projection portion of the electrically insulating flexible layer is elastically curved to have a U-shaped cross section.

27. The inkjet recording head according to claim 15, wherein the channel unit includes, as said at least one first electrically conductive member, a first electrically conductive layer, and additionally includes at least one second electrically conductive layer which is stacked on the first electrically conductive layer.

28. An inkjet recording head, comprising:

a channel unit including an electrically conductive portion, and having a plurality of pressure chambers which communicate with a plurality of nozzles, respectively;

a plurality of individual actuators each of which applies a pressure change to a corresponding one of the pressure chambers so as to eject a droplet of ink from a corresponding one of the nozzles; and a flexible flat cable including a plurality of individual wires which are electrically connected to the plurality of individual actuators, respectively, a grounding wire which is commonly connected to the individual actuators and is held at a ground potential, and an electrically insulating flexible layer which supports the individual wires and the grounding wire, wherein the grounding wire includes a connection portion which is electrically connected to the electrically conductive portion of the channel unit, and the electrically insulating flexible layer includes a support portion which supports at least a portion of the connection portion of the grounding wire.

* * * * *